US011674485B2

(12) United States Patent
Fipp et al.

(10) Patent No.: US 11,674,485 B2
(45) Date of Patent: Jun. 13, 2023

(54) FLUID FILTERING DEVICES AND SYSTEMS

(71) Applicant: Cummins Inc., Columbus, IN (US)

(72) Inventors: Robert G. Fipp, Columbus, IN (US); Aaron M. Motz, Greenwood, IN (US)

(73) Assignee: Cummins Inc., Columbus, IN (US)

( * ) Notice: Subject to any disclaimer, the term of this patent is extended or adjusted under 35 U.S.C. 154(b) by 287 days.

(21) Appl. No.: 16/931,107

(22) Filed: Jul. 16, 2020

(65) Prior Publication Data

US 2022/0018320 A1 Jan. 20, 2022

(51) Int. Cl.

| | |
|---|---|
| ***F02M 37/44*** | (2019.01) |
| ***F02M 37/34*** | (2019.01) |
| ***F02M 37/42*** | (2019.01) |
| ***F02M 37/52*** | (2019.01) |
| ***F02M 59/46*** | (2006.01) |
| ***F02M 59/34*** | (2006.01) |

(52) U.S. Cl.

CPC ..... *F02M 37/44* (2019.01); *F02M 37/34* (2019.01); *F02M 37/42* (2019.01); *F02M 37/52* (2019.01); *F02M 59/34* (2013.01); *F02M 59/46* (2013.01)

(58) Field of Classification Search

CPC ..... F02M 37/44; F02M 37/34; F02M 37/42; F02M 37/52; F02M 59/34; F02M 59/46; F02M 2200/27; F02M 59/44

USPC ..... 210/416.4, 433.1, 435, 439, 446, 450, 210/167.03, 172.3, 222, 223, 337, 338, 210/342, 322, 335

See application file for complete search history.

(56) References Cited

U.S. PATENT DOCUMENTS 4,036,758 A * 7/1977 Combest ..... B01D 29/114 210/451

* cited by examiner

*Primary Examiner* — Madeline Gonzalez

(74) *Attorney, Agent, or Firm* — Taft, Stettinius & Hollister LLP

(57) ABSTRACT

A fluid filtering device may have a body that include a fluid collection portion, a filtering chamber, and a passthrough bore. The fluid collection portion may be configured to collect fluid supplied to the fluid filtering device. The filtering chamber may be in fluid communication with the fluid collection portion. The filtering chamber may have an entrance portion, an exit portion, and a fluid filter. The filtering chamber may be configured to filter the fluid supplied to the fluid filtering device. The passthrough bore may be in fluid communication with the filtering chamber and may be separate from the fluid collection portion such that fluid flowing from the fluid collection portion flows into the filtering chamber, and the fluid flowing from the filtering chamber flows into the passthrough bore.

20 Claims, 5 Drawing Sheets

FLUID FILTERING DEVICES AND SYSTEMS

FIELD OF THE DISCLOSURE

The present disclosure generally relates to vehicles and more particularly to fuel filters for such vehicles.

BACKGROUND

Vehicles powered by internal combustion engines often use fuel pumps to supply fluid from a fuel tank to the internal combustion engine. Low-pressure fuel stored in a fuel tank is supplied to the fuel pump, the fuel pump pressurizes the fuel from a low-pressure fuel to a high-pressure fuel, and then the high-pressure fuel is delivered to the internal combustion engine. In common fuel rail systems for diesel internal combustion engines, fuel flowing from the fuel pump enters an inlet metering valve (IMV) and is then supplied to downstream components such as a common fuel rail that will supply the fuel to fluid injectors. The fluid injectors will then inject, directly or indirectly, fuel into a combustion chamber of the internal combustion engine. Fuel systems such as these are typically closed-looped systems that stabilize fuel pressure at the fuel rail close to or around a nominal value for a given engine operating condition. The fuel pump maintains pressure at the fuel rail by continuously delivering fuel to the fuel rail during operation. Just how much fuel is delivered to the fuel rail is regulated via the IMV. With increasing fuel consumption (e.g., due to driver demand), the IMV allows more fuel to be supplied to the internal combustion engine, and with decreasing fuel consumption (e.g., due to cessation of driver demand), the IMV allows less fuel to be supplied to the internal combustion engine (e.g., down to a nominal value). In this way, in most cases, only the amount of fuel required for a given engine operating condition is supplied to the fuel rail. Typically, any excess fuel supplied to the internal combustion engine is returned to the fuel tank for later use. Because only a required amount of fuel (or close to it) is pressurized, the fuel pump can operate at a high efficiency because the fuel pump is only operating when necessary. As well temperature increases in the fuel tank due to returning less high-temperature fuel resulting from being pressurized by the fuel pump may be limited.

Sudden engine failure events can be caused by failed or failing fuel pumps. In vehicles, these events often result in sudden loss of stopping power (e.g., hydraulic brakes) and assisted steering (e.g., power steering) because the engine shuts off due to compromised fuel flow. Internal debris (e.g., metal filaments) generated by operation of the fuel pump may compromise the operation of the fuel pump and downstream components thereof, such as the IMV and the fuel injectors via the fuel rail. As internal debris is generated within the fuel pump, flowing fuel carries the debris between these components where it can collect and impede optimal operation or otherwise cause internal damage. Because these components are involved in metering the amount of fuel delivered to the internal combustion engine, their comprised operation may cause unknown accounts of fuel to be delivered to the internal combustion engine, detrimentally compromising the benefits of metering the amounts of fuel delivered to the internal combustion engine. Under these circumstances, the engine will likely fail. For example, it may choke due to lack of adequate fuel supply or flood for due to excess fuel supply.

SUMMARY

The present disclosure advantageously filters internal debris from fuel pumps. Devices, systems, and methods in accordance with embodiments of the present disclosure filter internal debris from operating fuel pumps by rerouting the fuel for filtering while at a low-pressure side of the fuel pump, before the fuel flows downstream to components such as connected IMVs, fuel rails, and fuel injectors. Advantages of the present disclosure include inhibiting sudden engine failures by filtering internal debris generated by the fuel pump out from flowing fuel before it continues downstream. The present disclosure thereby inhibits internal debris from collecting in downstream components, which can lead to compromising their operation. In this way, filtering internal debris from flowing fuel slows the spread of internal debris into components downstream of the fuel pump. As such, in vehicles, instead of the engine suddenly failing without warning due to failure of downstream components, these components fail more slowly thereby allowing for adequate warning via vehicle systems or by the driver feeling compromised performance of the engine. As well, embodiments of the present disclosure that provide a filter for filtering fuel in this way further provide a diagnostic point for determining whether the fuel pump has failed or is failing by checking the filter for debris. Embodiments of the present disclosure are also useful for filtering fuel in fuel pumps with only internal fuel passages between a low-pressure side and a high-pressure side of the fuel pump. In embodiments, the fluid filtering device may advantageously be a bolt-on adapter, allowing for retrofitting into existing applications.

A fluid filtering device according to embodiments of the present disclosure may have a body that include a fluid collection portion, a filtering chamber, and a passthrough bore. The fluid collection portion may be configured to collect fluid supplied to the fluid filtering device. The filtering chamber may be in fluid communication with the fluid collection portion. The filtering chamber may have an entrance portion, an exit portion, and a fluid filter. The filtering chamber may be configured to filter the fluid supplied to the fluid filtering device. The passthrough bore may be in fluid communication with the filtering chamber and may be separate from the fluid collection portion such that fluid flowing from the fluid collection portion flows into the filtering chamber, and the fluid flowing from the filtering chamber flows into the passthrough bore. In embodiments, the fluid filter may include a magnet portion and a screen portion.

In embodiments, the fluid filter may be movable relative to the filtering chamber. In such embodiments, the fluid filtering device may include a biasing member configured to inhibit movement of the fluid filter within the filtering chamber. In embodiments, the fluid filtering device may include a filtering chamber cover that is removably coupleable to the body and, upon removal, is configured to provide access to the fluid filter. In embodiments, the fluid filtering device may include a filtering chamber seal positioned between the filtering chamber cover and the filtering chamber.

A fuel pump assembly may include an inlet metering valve (an IMV), a fuel pump, and a fluid filtering device. The fuel pump may be configured to supply fuel to the IMV. The fluid filtering device may be coupled between the IMV and the fuel filter and in fluid communication with both the IMV and the fuel pump. The fluid filtering device may be similar to those disclosed elsewhere. In embodiments, the body of the fluid filtering device may include a fuel-pump side and an IMV side separate from the fuel-pump side. The fuel-pump side may include a fuel-pump-side interface that is configured to couple to the fuel pump. The IMV side may include an IMV-side interface that is configured to couple to the IMV. In embodiments, the fuel pump assembly may include a system of internal fuel passages formed between each of the IMV, the fuel pump, and the fluid filtering device, and fuel may pass between each of the IMV, the fuel pump, the fluid filtering device through the system of internal fuel passages.

The present disclosure also includes a method for externally filtering fuel flowing internally within a fuel pump. The method can include receiving, at a low-pressure side of the fuel pump, a fuel flow that is flowing toward a high-pressure side of the fuel pump. The method can include rerouting the fuel flow to be externally filtered by a fuel filter having at least two different filter elements. The fuel flow may be a filtered fuel flow after being filtered by the at least two different filter elements. The method can include receiving the filtered fuel flow at a low-pressure side of the fuel pump. The method can include causing the filtered fuel flow to flow toward the high-pressure side of the fuel pump.

Additional features and advantages of the present disclosure will become apparent to those skilled in the art upon consideration of the following detailed description of the illustrative embodiments exemplifying the disclosure as presently perceived.

BRIEF DESCRIPTION OF THE DRAWINGS

The above-mentioned and other features and advantages of this disclosure, and the manner of obtaining them, will become more apparent, and will be better understood by reference to the following description of the exemplary embodiments taken in conjunction with the accompanying drawings, wherein.

Figure 1:
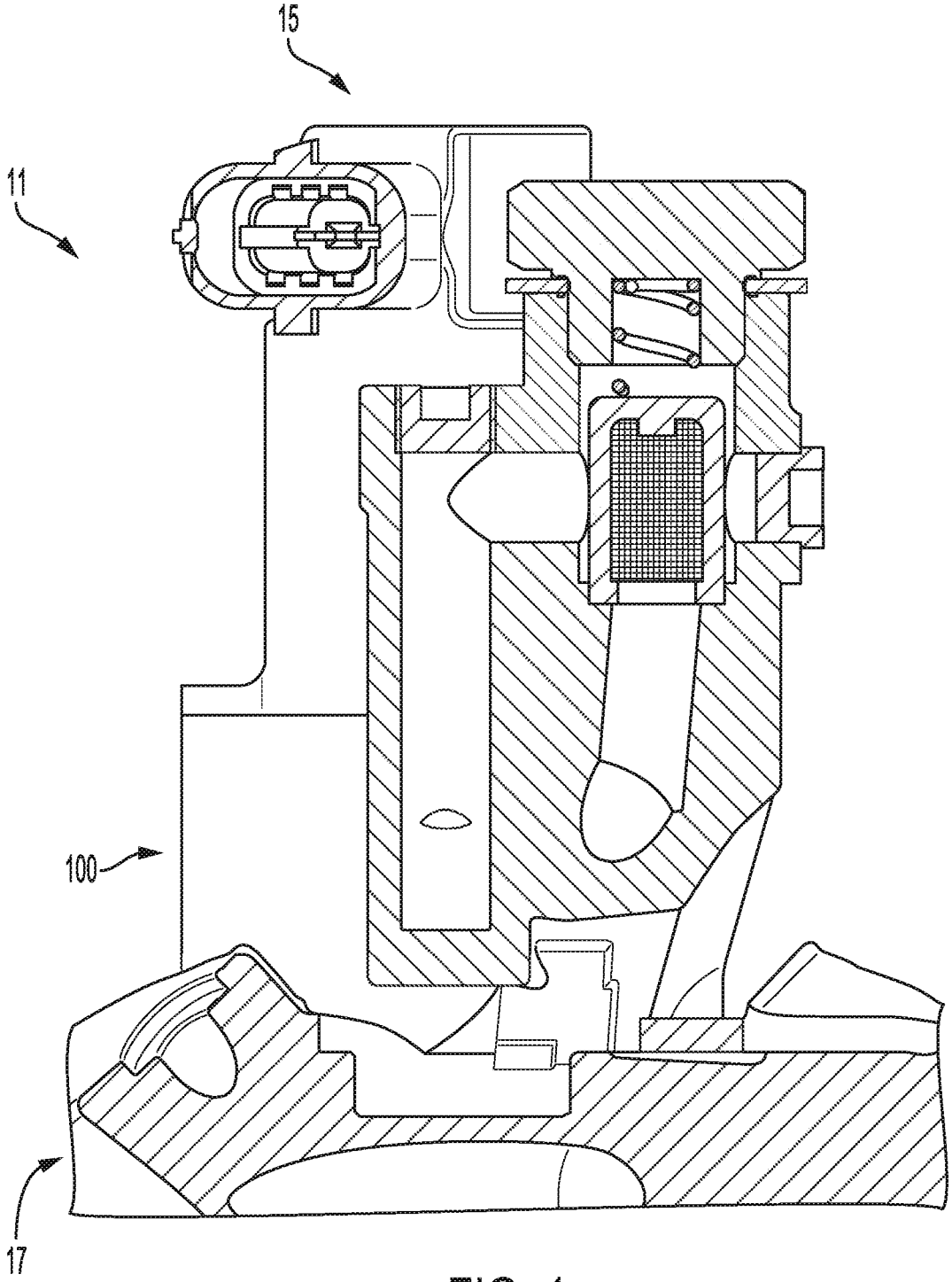
FIG. 1 is a partial side elevation view of a cross section of a fuel pump assembly in accordance with embodiments of the present disclosure.

Corresponding reference characters indicate corresponding parts throughout the several views. Although the drawings represent embodiments of various features and components according to the present disclosure, the drawings are not necessarily to scale and certain features may be exaggerated in order to better illustrate and explain the present disclosure. The exemplification set out herein illustrates an embodiment of the invention, and such an exemplification is not to be construed as limiting the scope of the invention in any manner.

DETAILED DESCRIPTION OF THE DRAWINGS

For the purposes of promoting an understanding of the principles of the present disclosure, reference is now made to the embodiments illustrated in the drawings, which are described below. The exemplary embodiments disclosed herein are not intended to be exhaustive or to limit the disclosure to the precise form disclosed in the following detailed description. Rather, these exemplary embodiments were chosen and described so that others skilled in the art may utilize their teachings. It is not beyond the scope of this disclosure to have a number (e.g., all) the features in a given embodiment to be used across all embodiments.

FIG. 1 is a partial side elevation view of a cross section of a fuel pump assembly 11 in accordance with embodiments of the present disclosure. A fuel pump assembly 11 may include an inlet metering valve 15 (an IMV 15), a fuel pump 17, and a fluid filtering device 100. The fuel pump 17 may be configured to supply fuel to the IMV 15. Fuel flowing from the IMV 15 (e.g., from the low-pressure side) may be pressurized by a high-pressure pump before being delivered at high pressures to the internal combustion engine with any excess amounts of fuel being returned to the fuel tank. The fluid filtering device 100 may be coupled between the IMV 15 and in fluid communication with both the IMV 15 and the fuel pump 17. In this way, the fluid filtering device 100 may filter internal debris from fuel flowing through the fuel pump assembly 11. For example, instead of allowing fuel to be delivered directly from the fuel pump 17 to the IMV 15, fuel flowing through fuel passages in the fuel pump 17 may be rerouted through the fluid filtering device 100 for filtering before the fuel flows into the IMV 15.

Fuel flow of the fuel pump assembly 11 (e.g., from a high-pressure side to a low-pressure side) may occur through a system of internal fuel passages formed between components of the fuel pump assembly 11. In embodiments, the fuel pump assembly 11 may include a system of internal fuel passages formed between each of the IMV 15, the fuel pump 17, and the fluid filtering device 100, and fuel may pass between each of the IMV 15, the fuel pump 17, the fluid filtering device 100 through the system of internal fuel passages. Mating portions of the IMV 15, fluid filtering device 100, and fuel pump 17 may form joints or junctions in the system of internal fuel passages. Some portions of the system of internal fuel passages may be generally U-shaped to return fluid flowing away from a passthrough bore, through which fuel in the low-pressure side may be delivered to the IMV 15 before entering the high-pressure side, back toward the passthrough bore. Other portions of the system of internal fuel passages may be longitudinally extending. In any of these instances, fuel may pass from a low-pressure side of the fuel pump 17 through the fluid filtering device 100, through the IMV 15, and then into a high-pressure side of the fuel pump 17 through the system of internal fuel passages. After exiting the high-pressure pump in the fuel pump 17, fuel may flow to downstream components such as a fuel rail and fuel injectors in a common rail vehicle. As such, the fuel pump assembly 11 may form at least a portion of a closed-loop fuel delivery system in a vehicle.

Figure 2A:
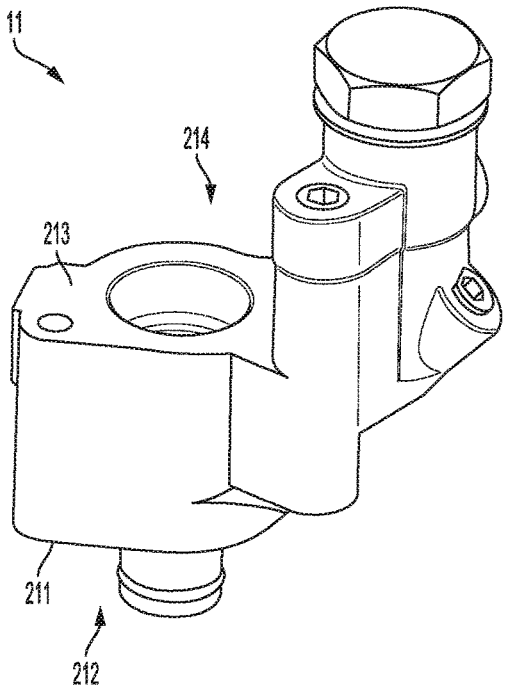
FIG. 2A is a perspective view of a fluid filtering device in accordance with embodiments of the present disclosure.
Figure 2B:
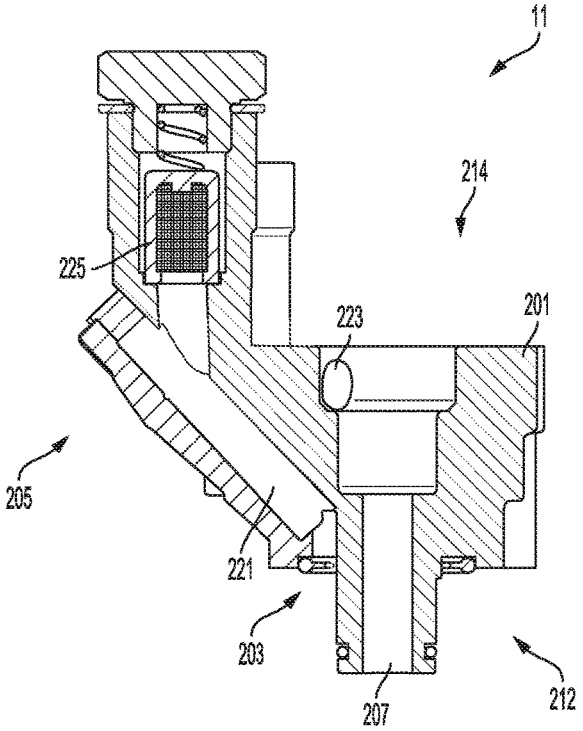
FIG. 2B is a right-side elevation view of a cross section of a fluid filtering device in accordance with embodiments of the present disclosure.

FIGS. 2A and 2B show various views of the fluid filtering device 100. FIG. 2A is a perspective view of the fluid filtering device 100. And FIG. 2B is a side elevation view of a cross section of the fluid filtering device 100.

Interfaces between the IMV and the fuel pump may be mimicked by the fluid filtering device 100 such that the fluid filtering device 100 may be a bolt-on component in existing platforms. In embodiments, a body 201 of the fluid filtering device 100 may include a fuel-pump side 211 and an IMV side 213 separate from the fuel-pump side 211. The fuel-pump side 211 may include a fuel-pump-side interface 212 that is configured to couple to the fuel pump. The IMV side 213 may include an IMV-side interface 214 that is configured to couple to the IMV. In embodiments, the IMV may include an IMV interface that has an IMV inlet and that is configured to couple to the IMV-side interface 214 of the fluid filtering device 100. In embodiments, the fuel pump may include a fuel pump interface that has a fuel delivery passage and that is configured to couple to the fuel-pump-side interface 212 of the fluid filtering device 100. The fuel delivery passage may deliver to-be-filtered fuel to the fluid filtering device 100. The fuel-pump-side interface 212 may mimic the IMV interface, and the IMV-side interface 214 may mimic the fuel pump interface.

The fluid filtering device 100 may have a body 201 that includes a fluid collection portion 203, a filtering chamber 205, and a passthrough bore 207. The fluid collection portion 203 may be configured to collect fluid supplied to the fluid filtering device 100. The filtering chamber 205 may be in fluid communication with the fluid collection portion 203. The filtering chamber 205 may have an entrance portion 221, an exit portion 223, and a fluid filter 225. The filtering chamber 205 may be configured to filter the fluid supplied to the fluid filtering device 100. Fuel flowing from the filtering chamber 205 may enter the passthrough bore 207. The passthrough bore 207 may be in fluid communication with the filtering chamber 205 and may be separate from the fluid collection portion 203.

Figure 3A:
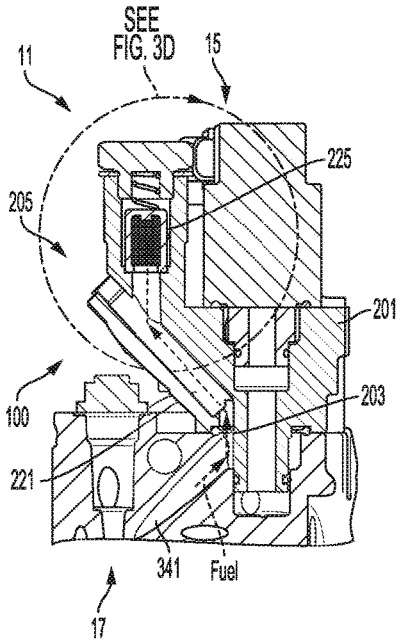
FIG. 3A is a right-side elevation view of a cross section of a fuel pump assembly in accordance with embodiments of the present disclosure.
Figure 3B:
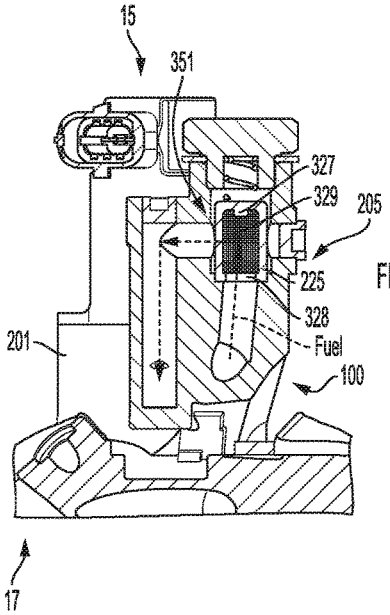
FIG. 3B is a rear elevation view of a cross section of a fuel pump assembly in accordance with embodiments of the present disclosure.
Figure 3C:
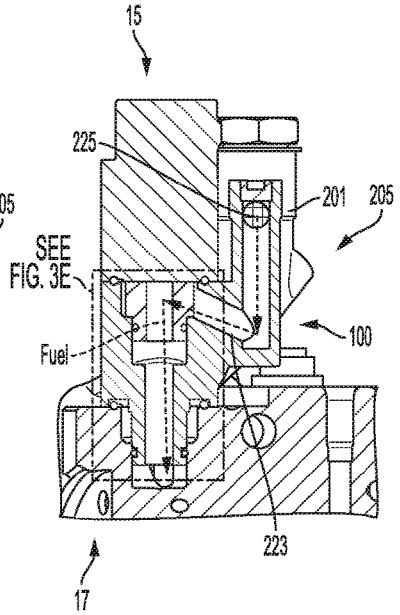
FIG. 3C is a left-side elevation view of a cross section of a fuel pump assembly in accordance with embodiments of the present disclosure.
Figure 3D:
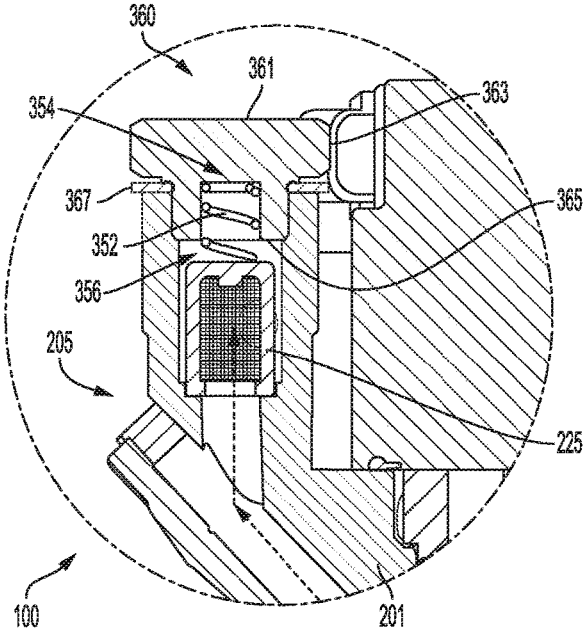
FIG. 3D is a close-up view of Detail A in FIG. 3A.
Figure 3E:
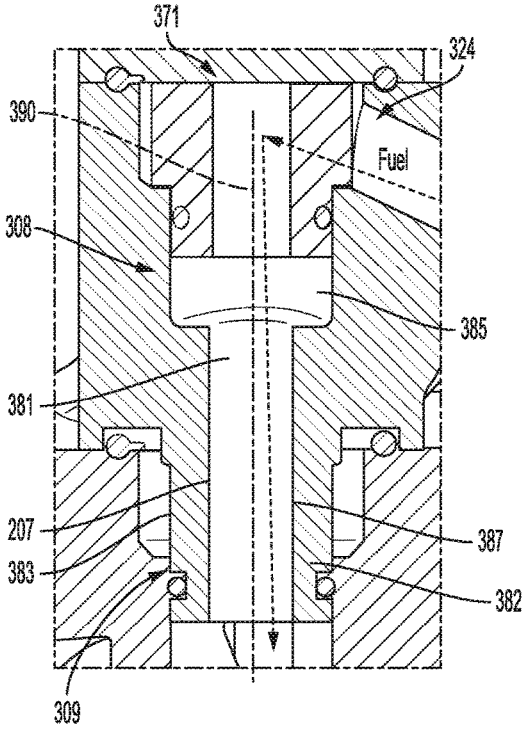
FIG. 3E is a close-up view of Detail B in FIG. 3C.

FIGS. 3A-3B show how fuel flows through a relevant portion of the fuel pump assembly 11. FIG. 3A shows a right-side elevation view of a cross section of a fuel pump assembly 11. FIG. 3B shows a rear elevation view of a cross section of a fuel pump assembly 11. FIG. 3C shows a left-side elevation view of a cross section of a fuel pump assembly 11. FIG. 3D is a close-up view of Detail A in FIG. 3A. And FIG. 3E is a close-up view of Detail B in FIG. 3C

Components included in the body 201 can be arranged to reroute fluid from the low-pressure side of the fuel pump 17 to the filtering chamber 205 before it flows into the high-pressure side of the fuel pump 17. As noted prior, fuel may flow through the fuel pump assembly 11 (e.g., from the low-pressure side to the high-pressure side) via the system of internal fuel passages. The fuel delivery passage 341 may be configured to supply fuel to the fluid collection portion 203 of the fluid filtering device 100. Fluid flowing from the fluid collection portion 203 may flow into the filtering chamber 205. While in the filtering chamber 205, internal debris may be removed from the flowing fuel via a fluid filter 225 as described further hereinafter. The fluid flowing from the filtering chamber 205 flows into the passthrough bore 207, fuel flowing through the passthrough bore 207 may enter the IMV before flowing into the high-pressure side of the pump, where a high-pressure pump will pressurize the now metered amount of fuel. After entering the high-pressure side of the pump, the pressurized fuel flows, for example, into a fuel rail to be delivered to fluid injectors that spray fuel into the combustion chamber of an internal combustion engine.

Fuel may be inline filtered within the system of internal fuel passages via a fluid filter 225. In embodiments, the fluid filter 225 may be positioned between the entrance portion 221 and the exit portion 223. For example, the fluid filter 225 may be positioned nearer the entrance portion 221 than the exit portion 223 or, on the other hand, nearer the exit portion 223 than the entrance portion 221 or in the middle of the entrance portion 221 and the exit portion 223. In another example, the fluid filter 225 may be positioned at a junction 351 of internal fuel passages within the filtering chamber 205. As fluid flow may slow at this junction 351, fluid filtering via the fluid filter 225 may be facilitated by occurring at lower speeds than that of fuel flow in other portions of the system of internal fuel passages.

In embodiments, the fluid filter 225 may include a magnet portion 327 (e.g., comprising a magnet) and a screen portion 328 (e.g., comprising a screen). More than one magnet, more than one screen, or both may be included in the fluid filter 225. In embodiments, the magnet portion 327 may be downstream of the screen portion 328. For example, the screen portion 328 and the magnet portion 327 may form a basket-type fluid filter 225 with the screen portion 328 extending outwardly from the periphery of the magnet portion 327 at a base of the fluid filter 225 to an opening 329 at an opposite end of the fluid filter 225. Flowing fuel may enter the fluid filter 225 through the opening 329 and be filtered by passing through the screen portion 328, by attraction to the magnet portion 327, or both. Under these circumstances, the fluid filter 225 may be oriented such that the opening 329 is upstream of the magnet. There are embodiments, however, where the fluid filter 225 is oriented differently, e.g., such that the magnet portion 327 is upstream of the screen portion 328 or such that a length of the fluid filter 225 is perpendicular to the direction of fluid flow.

The fluid filter 225 may be movable relative to the filtering chamber 205. In this way, the fluid filter 225 may be removable, for example, for replacement, inspection, or cleaning. In such embodiments, the fluid filtering device 100 may include a biasing member 352 configured to inhibit movement of the fluid filter 225 within the filtering chamber 205 (e.g., by biasing the fluid filter 225 in a direction opposite to that of fluid flow). As discussed further hereinafter, the biasing member 352 may be coupled between the fluid filter 225 and the filtering chamber cover 361.

In embodiments, the fluid filtering device 100 may include a filtering chamber cover 361 that is removably coupleable to the body 201 and, upon removal, is configured to provide access to the fluid filter 225. A removable screw top 361 may serve as the filtering chamber cover 361 and, thus, may be removable by screwing and unscrewing threads (not shown) of the removable screw top through corresponding threads (not shown) in the body 201. The removable screw top may have a handle portion 363 and a tip 365 opposite the handle portion 363. Threads of the removable screw top may be between the handle portion 363 and the tip 365. The tip 365 may be configured to mate with a portion of the biasing member 352, forming a biasing member 352 seat. Thus, when assembled, the biasing member 352 may abut the removable screw top at a first end 354 while abutting the fluid filter 225 on a second end 356 opposite the first end 354. In embodiments, the fluid filtering device 100 may include a filtering chamber seal 367 positioned between the filtering chamber cover 361 and the filtering chamber 205. The filtering chamber seal 367 may be any material suitable for fluidly sealing the removable screw top to the body 201.

Fluid passages in the filtering chamber 205 may be oriented with respect to the passthrough bore 207 to facilitate fluid flow through the fuel pump assembly 11. In embodiments, the passthrough bore 207 comprises an upstream portion 308 and a downstream portion 309. In such embodiments, both the entrance portion 221 and the exit portion 223 extend in a direction generally from the downstream portion 309 of the passthrough bore 207 to the upstream portion 308 of the passthrough bore 207. In embodiments, at least one of the entrance portion 221 and the exit portion 223 may longitudinally extend at an angle relative to a central axis 390 of the passthrough bore 207. In embodiments, both the entrance portion 221 and the exit portion 223 may longitudinally extend at an angle relative to the central axis 390 of the passthrough bore 207. The exit portion 223 may extend in a direction generally from a downstream portion 309 of the passthrough bore 207 to an upstream portion 308 of the passthrough bore 207 such that an outlet 324 of the exit portion 223 of the filtering chamber 205 is directed toward the IMV inlet 371.

The passthrough bore 207 may generally be in the form of a tubular member that is offset from the filtering chamber 205. In embodiments, the passthrough bore 207 may be defined by an inner surface 381 of a passthrough bore wall 382, and the fluid collection portion 203 may be defined by an outer surface 383 of the passthrough bore wall 382. In embodiments, the fluid filtering device 100 may include a fluid seal positioned along at least a portion of the outer surface 383 of the passthrough bore wall 382. The fluid seal may be configured to engage and seal with a connected fuel pump 17. In embodiments, an upstream portion 308 of the passthrough bore 207 may include a mouth portion 385 having a first diameter, and a downstream portion 309 of the passthrough bore 207 may include an elongate portion 387 having a second diameter that is smaller than the first diameter. Together, the mouth and the elongate portion 387 may form an inner surface 381 of the passthrough bore 207. In embodiments, an outlet 324 of the exit portion 223 may open into the mouth portion 385 of the passthrough bore 207.

Figure 4:
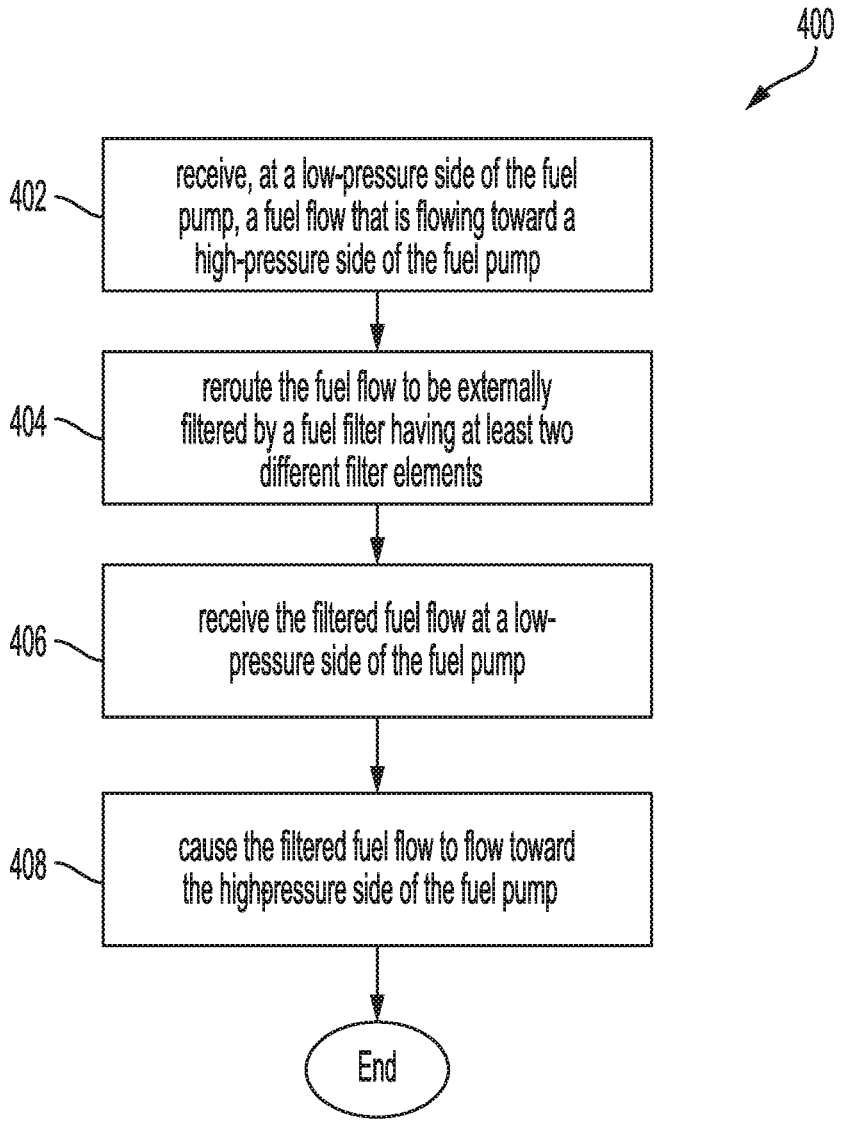
FIG. 4 is a flowchart of a method in accordance with embodiments of the present disclosure.

The present disclosure also includes a method 400 for externally filtering fuel flowing internally within a fuel pump as shown in FIG. 4. At step 402, the method 400 can include receiving, at a low-pressure side of the fuel pump, a fuel flow that is flowing toward a high-pressure side of the fuel pump. At step 404, the method 400 can include rerouting the fuel flow to be externally filtered by a fuel filter having at least two different filter elements. The fuel flow may be a filtered fuel flow after being filtered by the at least two different filter elements. At step 406, the method 400 can include receiving the filtered fuel flow at a low-pressure side of the fuel pump. At step 408, the method 400 can include causing the filtered fuel flow to flow toward the high-pressure side of the fuel pump.

In embodiments, the method 400 may employ devices or features similar to those fluid filtering devices disclosed elsewhere herein. For example, in embodiments the at least two different filter elements may include a magnet portion and a screen portion. In embodiments, rerouting the fuel flow to be externally filtered by the fuel filter having the at least two different filter elements may include slowing the fuel flow at a junction where the at least two different filter elements are positioned. In embodiments, receiving, at the low-pressure side of the fuel pump, the fuel flow that is flowing toward the high-pressure side of the fuel pump may be performed via a fluid collection portion, and rerouting the fuel flow to be externally filtered by the fuel filter having the at least two different filter elements may be performed via a filtering chamber.

While the present disclosure has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practices in the art to which this invention pertains.

What is claimed is:

1. A fluid filtering device comprising:

a body configured to couple to a low-pressure side of a fuel pump, the body including:

a fluid collection portion configured to collect fluid supplied to the fluid filtering device;

a filtering chamber in fluid communication with the fluid collection portion, the filtering chamber having an entrance portion, an exit portion, and a fluid filter having at least two filter elements, the filtering chamber being configured to filter the fluid supplied to the fluid filtering device; and a passthrough bore wall that defines a passthrough bore in fluid communication with the filtering chamber and separate from the fluid collection portion such that low-pressure fluid flowing toward the passthrough bore is rerouted away from the passthrough bore by the passthrough bore wall into the fluid collection portion before entering the passthrough bore, then flowing from the fluid collection portion into the filtering chamber to be filtered, and then flowing from the filtering chamber into the passthrough bore.

2. The fluid filtering device of claim 1, wherein the fluid filter is positioned between the entrance portion and the exit portion.

3. The fluid filtering device of claim 2, wherein the passthrough bore comprises an upstream portion and a downstream portion, and wherein both the entrance portion and the exit portion extend in a direction generally from the downstream portion of passthrough bore to the upstream portion of the passthrough bore.

4. The fluid filtering device of claim 3, wherein at least one of the entrance portion and the exit portion longitudinally extends at an angle relative to a central axis of the passthrough bore.

5. The fluid filtering device of claim 4, wherein both the entrance portion and the exit portion longitudinally extend at an angle relative to the central axis of the passthrough bore.

6. The fluid filtering device of claim 1, wherein the passthrough bore is defined by an inner surface of the passthrough bore wall, and wherein the fluid collection portion is defined by an outer surface of the passthrough bore wall.

7. The fluid filtering device of claim 6 further comprising a fluid seal positioned along at least a portion of the outer surface of the passthrough bore wall, the fluid seal being configured to engage and seal with a connected fuel pump.

8. The fluid filtering device of claim 1, wherein the at least two filter elements of the fluid filter includes a magnet portion and a screen portion.

9. The fluid filtering device of claim 8, wherein the fluid filter is movable relative to the filtering chamber, and wherein the fluid filtering device further comprises a biasing member configured to inhibit movement of the fluid filter within the filtering chamber.

10. The fluid filtering device of claim 1 further comprising a filtering chamber cover that is removably coupled to the body and, upon removal, is configured to provide access to the fluid filter.

11. The fluid filtering device of claim 1, wherein:

the passthrough bore comprises an upstream portion and a downstream portion;

the upstream portion includes a mouth portion having a first diameter; and the downstream portion includes an elongate portion having a second diameter less than the first diameter.

12. The fluid filtering device of claim 11, wherein the exit portion of the filtering chamber outlets into the mouth portion of the passthrough bore.

13. The fluid filtering device of claim 12, further comprising an inlet metering valve at the mouth portion of the passthrough bore.

14. The fluid filtering device of claim 11, wherein the mouth portion and the elongate portion form an inner surface of the passthrough bore.

15. The fluid filtering device of claim 11, wherein the passthrough bore wall includes an outer surface and further comprising a fluid seal positioned around the outer surface for sealingly engaging the fuel pump.

16. A fluid filtering device for filtering fluid associated with a fuel pump, the fluid filtering device comprising:

a fluid collection portion configured to collect fluid supplied to the fluid filtering device from the fuel pump;

a filtering chamber in fluid communication with the fluid collection portion, the filtering chamber having a fluid filter, the fluid filter being configured to filter the fluid received from the fluid collection portion; and a passthrough bore wall downstream of the filtering chamber, the passthrough bore wall defining a passthrough bore in fluid communication with the filtering chamber to receive filtered fluid from the filtering chamber, wherein the passthrough bore is configured to provide the filtered fluid to the fuel pump and the passthrough bore wall is configured to direct fluid flowing into the fluid filtering device into the fluid collection portion.

17. The fluid filtering device of claim 16, wherein the filtering chamber includes an entrance portion that receives fluid from the fluid collection portion and an exit portion that provides filtered fluid to the passthrough bore.

18. The fluid filtering device of claim 17, wherein:

the passthrough bore comprises an upstream portion and a downstream portion;

the upstream portion of the passthrough bore includes a mouth portion and the exit portion of the filtering chamber outlets into the mouth portion; and the downstream portion of the passthrough bore includes an elongate portion extending from the mouth portion.

19. The fluid filtering device of claim 18, further comprising an inlet metering valve at the mouth portion of the passthrough bore.

20. The fluid filtering device of claim 18, wherein the mouth portion and the elongate portion form an inner surface of the passthrough bore, and the mouth portion has a first diameter, the elongate portion has a second diameter, and the second diameter is less than the first diameter.

* * * * *